US005733230A

United States Patent [19]

Sawchuck et al.

[11] Patent Number: 5,733,230

[45] Date of Patent: Mar. 31, 1998

[54] PERINEOMETER FOR DOMESTIC USE IN PREVENTION OF URINARY INCONTINENCE AND METHOD OF USING THE SAME

[76] Inventors: Diane J. Sawchuck, 3917 West 29th Avenue, Vancouver, British Columbia, Canada, V6S 1V2; Kenneth L. Pinder, 4195 Doncaster Way, Vancouver, British Columbia, Canada, V6S 1W1

[21] Appl. No.: 604,610

[22] Filed: Feb. 21, 1996

[51] Int. Cl.[6] ..... A63B 23/20

[52] U.S. Cl. ..... 482/111; 482/112; 128/778; 601/45

[58] Field of Search ..... 128/774, 778, 128/830, 886, 834, 836, 841, 885, 897, 898, DIG. 25; 600/29–31; 623/11; 482/111, 112; 601/45, 148–150

[56] References Cited

U.S. PATENT DOCUMENTS

| | | | |
|---|---|---|---|
| 3,554,184 | 1/1971 | Habib | 128/834 |
| 3,752,150 | 8/1973 | Harris . | |
| 3,933,147 | 1/1976 | Du Vall et al. | 128/778 |
| 4,048,985 | 9/1977 | Sasse . | |
| 4,050,449 | 9/1977 | Castellana et al. . | |
| 4,167,938 | 9/1979 | Remih . | |
| 4,216,783 | 8/1980 | Kaiser et al. . | |
| 4,241,912 | 12/1980 | Mercer et al. . | |
| 4,476,880 | 10/1984 | Giem et al. . | |
| 4,515,167 | 5/1985 | Hochman . | |
| 4,574,791 | 3/1986 | Mitchener . | |
| 4,653,514 | 3/1987 | Shapiro . | |

(List continued on next page.)

FOREIGN PATENT DOCUMENTS

| | | | |
|---|---|---|---|
| 9217573 | 12/1992 | Australia . | |
| 4134116 | 4/1993 | Germany | 128/778 |
| 4225520 | 2/1994 | Germany | 128/836 |
| 1375244 | 2/1988 | U.S.S.R. | 128/778 |
| 1532360 | 11/1978 | United Kingdom . | |
| 2187959 | 9/1987 | United Kingdom . | |

OTHER PUBLICATIONS

Brubaker, et al.,"Kegel or Cut? Variations on His Theme", Journal of Reproductive Medicine, vol. 38, No. 9, 1983, pp. 672–678.

Workman, et al., "Validation of surface EMG as a measure of intravaginal and intra–abdominal activity: Implications for biofeedback–assisted Kegel exercises", Psychophysiology, 30 (1993), 120–125.

Gordon, et al., "Perineal Muscle Function After Childbirth", The Lancet, Jul. 20, 1985, pp. 123–125.

Kegel, "Early Genital Relaxation", Obstetrics and Gynecology, vol. 8, No. 5, 1956, pp. 545–550.

(List continued on next page.)

*Primary Examiner*—Jeanne M. Clark

*Attorney, Agent, or Firm*—Oyen Wiggs Green & Mutala

[57] ABSTRACT

This invention relates to a novel perineometer for domestic use and a method of using the same. More particularly, this invention pertains to a novel perineometer which can be used by a woman at home or in a non-medically controlled environment. Its use is specific to the rehabilitation of pelvic floor muscles by pelvic muscle exercises (PME) particularly following childbirth, to strengthen pelvic floor muscles to pre-childbirth condition, thereby reducing risk of future urinary incontinence. A perineometer for enabling a woman to conduct pelvic muscle exercises under domestic conditions comprising: (a) a generator for generating pneumatic pressure in the perineometer; (b) a flexible pneumatically inflatable hollow bulb connected pneumatically to the manual pneumatic pressure generator (a); and (c) and a support connected to the pneumatic pressure generator (a) or bulb (b), said support supporting a microprocessor, a source of direct electrical current, an electronic pneumatic pressure sensor, a manually manipulatable memory switch electronically connected to the microprocessor, an on-off switch for controlling the transmission of electrical current from an electricity storage means and the microprocessor, and an electronic digital readout display enabling a woman using the perineometer to monitor the effectiveness of her pelvic floor muscle strengthening exercises by reference to the electronic digital readout display.

20 Claims, 5 Drawing Sheets

U.S. PATENT DOCUMENTS

| | | | |
|---|---|---|---|
| 4,666,447 | 5/1987 | Smith et al. . | |
| 4,768,522 | 9/1988 | Shapiro . | |
| 4,953,563 | 9/1990 | Kaiser et al. | 128/778 |
| 5,031,604 | 7/1991 | Dye | 601/150 |
| 5,213,557 | 5/1993 | Firth . | |
| 5,233,987 | 8/1993 | Fabian et al. | 128/778 |
| 5,256,123 | 10/1993 | Reinbolt . | |
| 5,562,717 | 10/1996 | Tippey et al. | 607/41 |
| 5,603,685 | 2/1997 | Tutrone, Jr. | 600/29 |

OTHER PUBLICATIONS

McIntosh, et al., "Pelvic Floor Rehabilitation in the Treatment of Incontinence", Journal of Reproductive Medicine, vol. 38, No. 9, 1993, pp. 662–666.

Elia, et al., "Pelvic Muscle Exercises: When Do They Work?", Obstetrics and Gynecology, vol. 8, No. 2, 1993, pp. 283–286.

Dougherty, et al., "Graded Pelvic Muscle Exercise" Journal of Reproductive Medicine, vol. 38, No. 9, 1993, pp. 684–691.

Thorp, Jr., et al., "Assessment of Perineal Floor Function: Electromyography With Acrylic Plug Surface Electrodes in Nulliparous Women", Obstetrics and Gynecology, vol. 78, No. 1, Jul. 1991, pp. 89–92.

Kegel, et al., "Progressive Resistance Exercise in the Functional Restoration of the Perineal Muscles", Journal of Obstetrics and Gynecology, vol. 56, 1948, pp.238–248.

PERINEOMETER FOR DOMESTIC USE IN PREVENTION OF URINARY INCONTINENCE AND METHOD OF USING THE SAME

FIELD OF THE INVENTION

This invention relates to a novel perineometer for domestic use. More particularly, this invention pertains to a novel perineometer which can be used by a woman at home or in a non-medical environment for treatment and rehabilitation of pelvic floor muscles by pelvic muscle exercises (PME). The benefits include improved vaginal tone after childbirth, maintenance of sexual health, and prevention of some forms of urinary incontinence, specifically stress incontinence.

BACKGROUND OF THE INVENTION

Urinary incontinence is a major health problem that affects 50 to 70 percent of the institutionalized female elderly and up to 30 percent of all older female adults. The most common form is stress urinary incontinence. Stress urinary incontinence results from a sudden rise in bladder pressure that exceeds urethral resistance. This rise occurs under conditions such as coughing, sneezing or lifting. Appropriate pelvic muscle exercises have been found to strengthen the skeletal muscles, which increases the capacity of these muscles to exert pressure against the urethra, and thus reduce or eliminate urinary incontinence.

It has been estimated that one million Canadians, from all age groups, suffer from urinary incontinence and only one in five seek medical help. Because of this, the sale of adult diapers has ballooned into a multibillion-dollar industry in North America, with advertisements running on prime time television. Yet in most cases, urinary incontinence can be either cured or significantly improved. (Dr. Gary Naglie, a specialist in geriatric medicine at the Toronto Hospital, Toronto, Ontario, claims there are a variety of different treatments, including pelvic exercises, medication and surgery.) It is widely recognized among obstetricians and gynecologists that three treatments exist for urinary incontinence, including pelvic exercises, medication and surgery.

The number of people afflicted with incontinence is bound to swell with North America's aging population. But it can also strike those in middle age, particularly women whose pelvic muscles have been stretched by childbirth. Hormonal changes accompanying menopause can exacerbate the problem. Indeed, incontinence might well become the next big health concern for many baby boomers.

There are three general categories of urinary incontinence—stress, urge and overflow. Each has a variety of causes and treatments. Learning techniques for better bladder control, or cutting back on caffeine, a bladder irritant, might be all that some patients require.

Certain drugs used to relax an overly sensitive bladder, which can be the underlying cause of urge incontinence, may cause unwanted side effects, including dry mouth, blurry vision, constipation and mental confusion. At the Toronto Hospital, Dr. Sidney Radomski said he and Dr. Naglie have found evidence that Nimodipine, a drug used to treat stroke patients, may relax the bladder without the unwanted side effects of other medications.

Surgery is another form of treatment for stress incontinence. Surgeons can now repair a sagging bladder by inserting miniaturized viewing equipment and surgical instruments through a few small incisions in the abdomen.

Sometimes leaky bladders can be corrected with artificial sphincters or collagen injections. As a general rule, surgery should be avoided if other treatments are effective.

Arnold H. Kegel was among the first to document the positive effects of isometric exercises on the pelvic floor musculature (Kegel, 1948, 1952, infra.). Kegel recommended the use of perineometers for biofeedback in pelvic muscle training.

Simultaneous exercise with biofeedback has been proven successful and corroborated by several investigators. A large variety of perineometer units is available for clinical and physician office use. They generally use an intravaginal balloon to record vaginal pressure. Some form of visual or auditory feedback is displayed to the patient. This type of device is simple to use and is relatively inexpensive. A disadvantage is that careful training is required. Even so, the exercises may be performed improperly notwithstanding careful training. Patients who increase their intraabdominal pressure will also elevate their vaginal pressure. This falsely indicates the same measurable outcome as on isolated pelvic contraction. Thus, patients under professional care using perineometers must receive proper instructions and be evaluated professionally from time to time to ensure that their efforts result in a properly performed, isolated pelvic contraction.

Arnold H. Kegel, in his article entitled "Progressive Resistance Exercise in the Functional Restoration of the Perineal Muscles", which appeared in the American Journal of Obstetrics and Gynecology, Vol. 56, 1948, disclosed the first design of perineometer. A pneumatic apparatus was devised specifically for the exercise of birth canal muscles, with measurement of each muscular contraction visible to the patient. A chart was provided to keep a record of the accomplishment of each exercise period and serve as a progress guide for both patient and physician. The apparatus consists of a simple, balanced-resistance pneumatic vaginal chamber operating at atmospheric pressure and connected by means of rubber tubing with a manometer calibrated from 0 to 100 mm. of mercury. In construction, the vaginal chamber is an anode-processed rubber cot of specified consistency, lightly stretched over a rigid slender core with a flange at each end. An air vent in the core connects the pneumatic chamber with the tubing and manometer. The base of the chamber is fitted with a round, semirigid rubber shield 8 cm. in diameter, which limits placement in the vagina and permits pivoting into position.

Two laboratory procedures have been developed for the evaluation and treatment of pelvic muscle functions. Burgio et al. (1986) inserted catheters into the bladder to monitor bladder pressure and pressure balloons into the anus and rectum to monitor anal sphincter and intra-abdominal pressure, respectively. Discrimination training involved contracting the anal sphincter, which is commonly innervated with the pubococcygeal and other pelvic muscles, while relaxing the abdominal musculature.

A second medical laboratory and physician procedure was used by Dougherty and her colleagues (Dougherty, Abrams & McKey, 1986). They developed a fluid-filled intravaginal balloon device that is inserted vaginally and is connected to a pressure transducer that provides digital and visual information regarding pelvic muscle contractions. They also developed a pressure-sensitive posterior balloon device that is placed in the fornix of the vagina (Dougherty, Bishop, Abrams, Batich a Gimotty, 1989) as a measure of intra-abdominal pressures. Using these devices, and in company of physicians, or other qualified therapists, patients learn to discriminate and enhance pelvic muscle contractions while minimizing counterproductive abdominal contractions.

While Dougherty et al. have reported excellent reliability and reproducibility using their technique, it is unlikely that their technique will find widespread clinical use because of its time-consuming nature. However, the technique may be an important adjunct in clinical trials using pelvic floor exercise as therapy for urinary incontinence.

H. Gordon et al., in an article entitled "Perineal Muscle Function after Childbirth", The Lancet, Jul. 20, 1985, disclose a perineometer for measuring perineal muscle function in European women one year after childbirth. The perineometer consists of a thin rubber condom, without a terminal teat, which can be inserted vaginally and inflated until the subject is just conscious of pressure. This gives the zero reading and subsequent pressure change is recorded on the gauge in cm water. The condom can be changed for each subject so the need for sterilization is eliminated, and it can be inflated to take account of variations in vaginal capacity. Once initial pressure causes the condom to inflate, the subsequent pressure needed to increase the volume is very small.

A number of patents have issued over the years disclose various designs of instruments for use in measuring perineal muscle strength, among other things.

| U.S. Pat. No. | Issue Date |
|---|---|
| 3,752,150 | August 14, 1973 |
| 4,048,985 | September 20, 1977 |
| 4,050,449 | September 27, 1977 |
| 4,167,938 | September 18, 1979 |
| 4,216,783 | August 12, 1980 |
| 4,241,912 | December 30, 1980 |
| 4,476,880 | October 16, 1984 |
| 4,515,167 | May 7, 1985 |
| 4,574,791 | May 11, 1986 |
| 4,653,514 | March 31, 1987 |
| 4,666,447 | May 19, 1987 |
| 4,768,522 | September 6, 1988 |
| 5,213,557 | May 25, 1993 |
| 5,256,123 | October 26, 1993 |
| Foreign Patents | |
| GB 1,532,360 | November 15, 1978 |
| GB 2,187,959 | September 23, 1987 |
| AU 92/17,573 | December 30, 1992 |
| DE 4,134,116 | April 22, 1993 |

SUMMARY OF THE INVENTION

The subject invention relates to a novel perineometer and accessories which can be used at home without direct medical supervision.

A perineometer for enabling a user to conduct pelvic muscle exercises under domestic conditions comprising: (a) means for manually generating pneumatic pressure in the perineometer; (b) flexible pneumatically inflatable hollow vaginal bulb means connected pneumatically to the manual pneumatic pressure means (a); and (c) instrument support means connected to the pneumatic pressure means (a) or vaginal bulb means (b), said support means supporting a microprocessing means, a source of direct electrical current, an electronic pneumatic pressure sensing means, a manually manipulatable memory switch electronically connected to the microprocessing means, an on-off switching means controlling the transmission of electrical current from the electricity storage means and the microprocessing means, and an electronic digital readout display enabling a domestic user of the perineometer to monitor the performance of the perineometer.

A pressure preset relief valve and a manual air release means can be connected between the manual pneumatic pressure means and the inflatable vaginal bulb. The perineometer can include a program in the microprocessing means to record past history of pneumatic pressure in the perineometer and enable the microprocessing means to instruct the perineometer to return to the historical pneumatic pressure level.

The microprocessing means can include programming to enable the domestic user to monitor time, fluctuations in pneumatic pressure in the vaginal bulb due to vaginal contractions of the domestic user, and count the frequency and number of the vaginal contractions.

The vaginal bulb can include a resilient, hollow inflatable shell, an internal elongated hollow air tube means to enable air to be pumped into or exhausted from the interior of the resilient vaginal bulb. The shell of the vaginal bulb can have a sheath-like construction, with an opening at one end, the end of the shell opposite the opening having in the interior thereof a resilient means for enabling the end of the vaginal bulb to retain its shape and a resilient means at the interior region of the shell proximate the opening, and a seal sealing the opening of the vaginal bulb to the pneumatic pressure means. The vaginal bulb of the perineometer means can include a flexible cover which removably fits over the shell.

The perineometer can include a flange mounted around the periphery of the air inlet and outlet tube means adjacent the shell. The support means of the perineometer can include manual button means for enabling the domestic user to increase or decrease the pneumatic pressure in the perineometer. An electric air pump which can be electrically connected to the microprocessing means and enable the microprocessing means to activate the electric air pump and pressurize the perineometer to a pressure programmed into the microprocessing means.

The perineometer can include a plurality of programmed pressure and relaxation sequences, which can be displayed on an electronic display panel, and can enable the domestic user to follow a program of perineal muscle contraction and rehabilitation procedures.

The perineometer can include an adjustable belt which can be worn by the domestic user to hold the vaginal bulb means in place in the vagina of the domestic user. The belt can include an adjustable length waist strap, an adjustable length crotch strap, and a means in the crotch strap for holding the vaginal bulb means. The waist strap and the crotch strap can have fasteners thereon which enable an end of the waist strap to be releasably secured to a body portion of the waist strap and an end of the crotch strap to be releasably secured to a body portion of the crotch strap.

In another aspect, the invention is directed to a method of conducting pelvic muscle exercises in a woman under domestic conditions using a perineometer comprising: (a) inserting flexible pneumatically inflatable hollow vaginal bulb means into the vagina of the woman; (b) manually generating pneumatic pressure in the bulb; (c) activating a microprocessing means, an electronic pneumatic pressure sensing means, a manually manipulatable memory switch electronically connected to the microprocessing means, and an electronic digital readout display with a source of direct electrical current, and enabling the woman to monitor the performance of pelvic muscle contractions on the perineometer.

The method can include connecting a high pressure preset relief valve means and a manual air release means between the manual pneumatic pressure means and the inflatable vaginal bulb to prevent pressure in the bulb exceeding a prescribed level.

The microprocessing means can be programmed with a record of past history of pneumatic pressure in the perineometer to enable the microprocessing means to command the perineometer to return to the historical pneumatic pressure level. The microprocessing means can also be programmed to enable the woman to monitor time, fluctuations in pneumatic pressure in the vaginal bulb due to vaginal contractions of the woman, and to count the frequency and number of the vaginal contractions.

Manual button means can be included for enabling the woman to activate an electric air pump which can be electrically connected to the microprocessing means, the electric air pump pressurizing the perineometer to a pressure programmed into the microprocessing means. A plurality of pressure and relaxation sequences can be programmed into the microprocessor and displayed on an electronic display panel which enables the woman to follow a program of perineal muscle contraction and rehabilitation procedures.

BRIEF DESCRIPTION OF THE DRAWINGS

In drawings which illustrate specific embodiments of the invention, but which should not be construed as restricting the spirit or scope of the invention in any way.

DETAILED DESCRIPTION OF SPECIFIC EMBODIMENTS OF THE INVENTION

Figure 1:
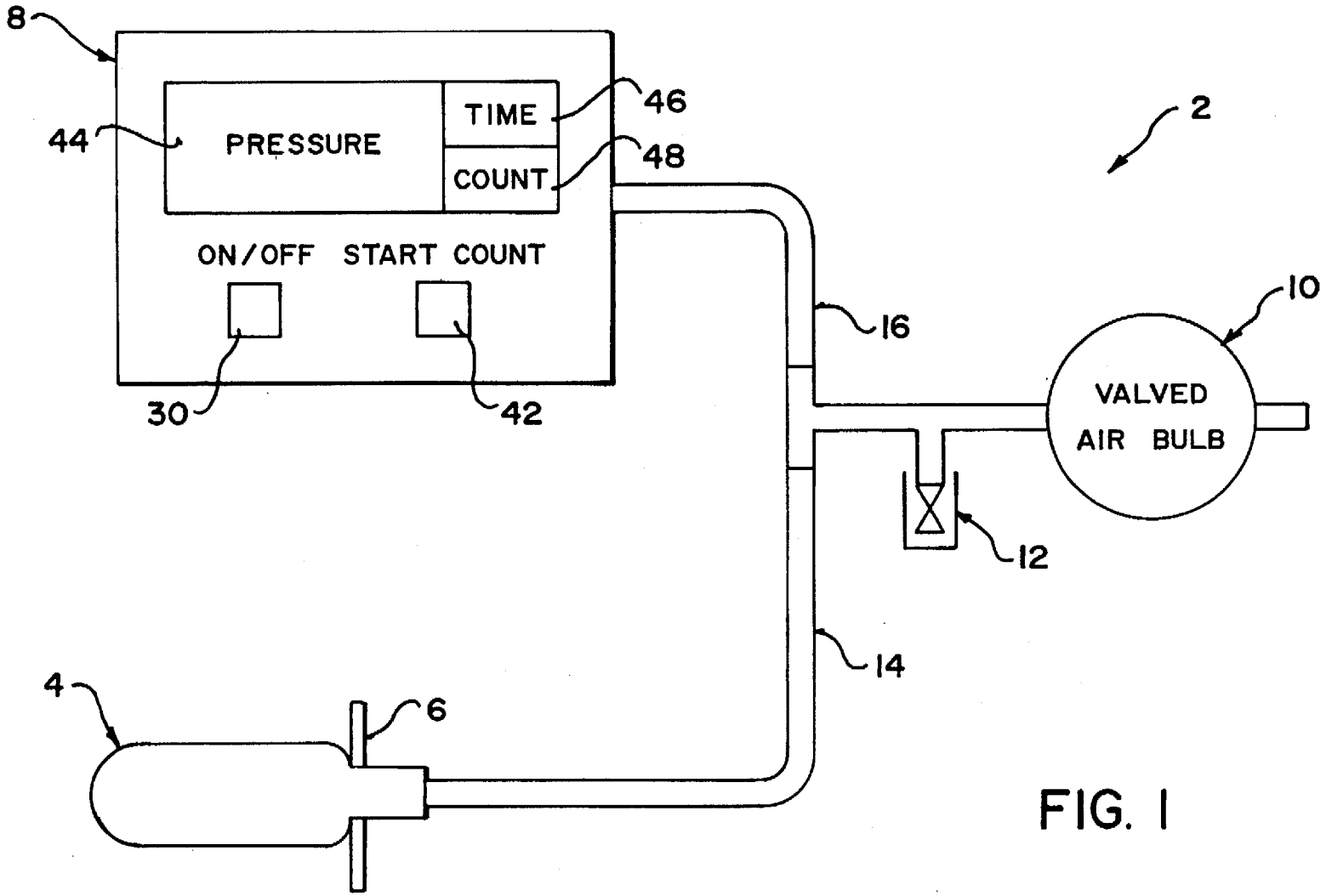
FIG. 1 illustrates a schematic view of a manual perineometer according to the invention.

Referring to the drawings, FIG. 1 illustrates a schematic view of a manual perineometer according to the invention. This is suitable for home use. Written instructions, as well as optional video and CD-Rom instructions, are provided. Supervision by a physician, physiotherapist or other health care provider is not required. The perineometer is sold in association with detailed instructions for use, as well as an optional instruction video. The perineometer 2, of the invention, is constructed of a resilient inflatable vaginal bulb 4 which has a flange 6 which impinges against the vulva area of the woman. The flange 6 prevents the patient over-inserting the bulb 4 into the vagina and potentially causing physical injury. A manually pressable air bulb 10, with a high pressure relief valve and manual air release 12, is connected to the vaginal bulb 4 by first air tube 14. A digital readout board is connected to the air bulb 10 by second air tube 16.

The valved air bulb 10 and the relief valve 12 are important because they prevent any possibility of over-inflation of the vaginal bulb 4, which a home use patient might do without professional supervision, even though full instructions are provided. This overinflation is especially possible with a patient who is commencing the program.

The readout board 8 has thereon a number of displays and manually controllable buttons. A manual on-off switch 30 can be manipulated by the home user to start or stop the electronics accompanying the perineometer 2. A manually manipulatable start-count button 42 enables the domestic user to start an electronic count to keep track of time in seconds and to count the number of vaginal contractions over a given time. The pressure of inflation of the flexible vaginal bulb 4 is disclosed in pressure readout 44. A running count of time in seconds is displayed in time display 46. The number of vaginal contractual counts is displayed on count 48.

As an option, the pressure indicator 44 can be programmed to monitor a prescribed inflation pressure and if the pressure exceeds that pressure, activate relief valve 12 until the pressure is rectified by lowering the air pressure to less than the specified pressure.

Figure 2:
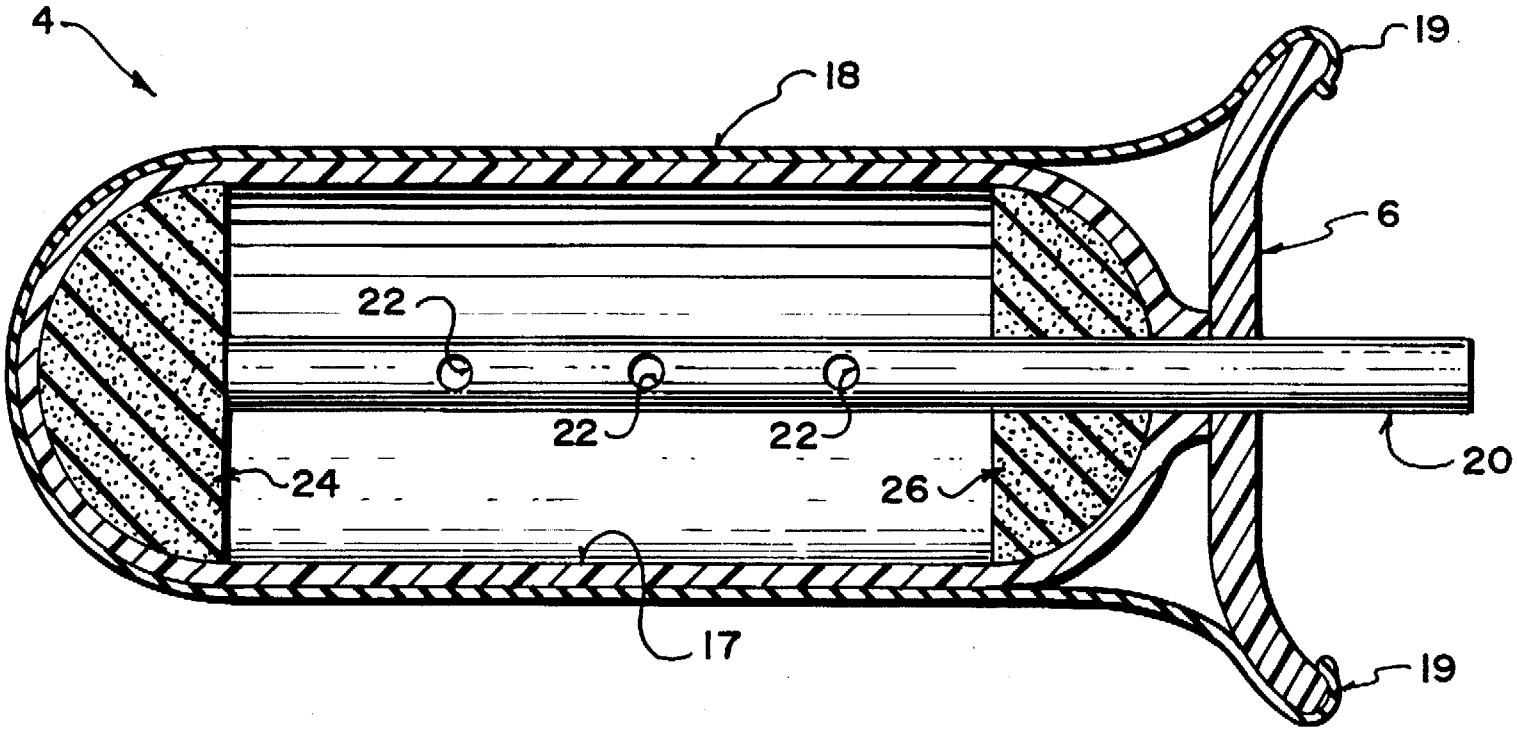
FIG. 2 illustrates a detail schematic view of a perineometer exercise bulb according to the invention.

FIG. 2 illustrates a detail schematic view of a perineometer exercise bulb 4 according to the invention. As seen in FIG. 2, the vaginal bulb 4 is sheath-like and adapted for insertion into the vagina. It includes a semi-firm round-end cylindrical shell 17, which is sufficiently stiff that it will not collapse when inserted in the vagina. It can be constructed of a suitable plastic such as polyethylene or latex. The air impermeable, semi-flexible and inflatable shell 17 supports a removable covering 18, which is preferably constructed of or covered with a non-allergenic material such as silicone rubber. If need be, a conventional latex condom can be used, if allergies are not a problem. However, other types of constructions and materials can be used. The shell 17 is open at one end and has extending therein an air inlet and outlet tube 20, which has a number of air ports 22 along its length. These allow air to pass into or out of the shell 17. Air inlet and outlet tube 20 is connected at the end opposite the vaginal bulb 4 to first air tube 14, as seen in FIG. 1.

To ease insertion into the vagina by providing support, and for comfort, the sheath-like shell 17 has at the closed end thereof, in the interior thereof, a resilient end liner 24. A corresponding resilient inside liner 26 is contained within the end of the shell 17, proximate to the flange 6. This provides comfort in the area of the vaginal opening and eases withdrawal from the vagina. The covering 18 fits over the edges of flange 6, as shown at 19.

While not shown, the shell 17 and covering 18 may be of a laminated construction combining both strength and resilience, if such a design is required. It is also important that both the shell 17 and covering 18 have sufficient resilience that they can conform to the shape of the vagina of the individual patient, while at the same time, they have sufficient overall strength not to over inflate at any one particular region. Common balloons, for instance, have weak areas and can be made to inflate at certain areas, while other areas remain uninflated. This uneven inflation phenomenon is to be avoided with the bulb 4. However, the structure of the walls of the bulb 4 and shell 17 must be sufficiently flexible to ensure that the proper pelvic floor muscles are contracted or flexed on the bulb 4 and true consistent measurements are obtained.

The cover 18 should either be washable after single use or be removable and replaceable on a one-time use basis for reliability and hygienic reasons. It should also be of a material and design that it can be readily installed over the shell 17 and flange 6, and readily removable when desired.

Figure 3:
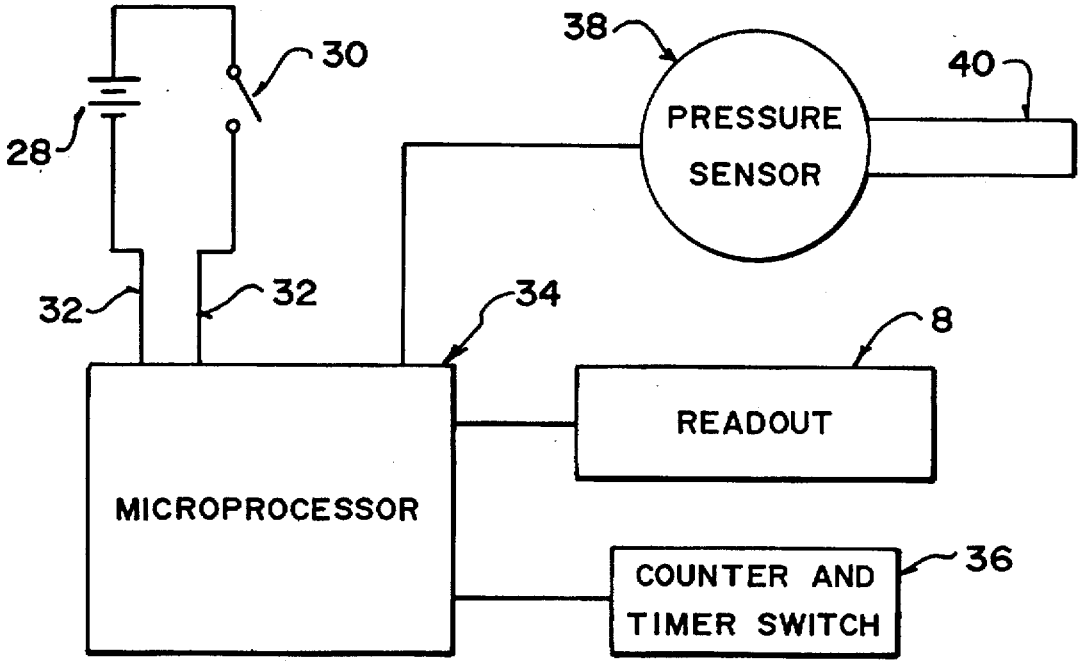
FIG. 3 illustrates a schematic view of electronics and instrumentation associated with the manual perineometer according to the invention.

FIG. 3 illustrates a schematic view of electronics and instrumentation associated with the manual embodiment of the perineometer according to the invention. As seen in FIG. 3, the electronics and instrumentation for the manual perineometer include a battery 28, which typically can be a rechargeable 2 to 12V cadmium battery, or a small large capacity long life 2V–12V lithium battery. The electronics should be such as to require only small voltage, for example 2 to 12 volts. Electrical low voltage current to operate the system can be delivered on an on-off basis via on-off switch 30, and electrical wires 32 to a microprocessor 34. The microprocessor 34 can be a conventional silicon chip type. The microprocessor 34 can be programmed using known programming techniques with operating instructions as well as a large almost unlimited number of alternative vaginal perineal muscle rehabilitation exercises if desired, or prescribed by a physician. For instance, one program can be a periodic series of five or ten second perineal muscle contractions, interrupted on a sequential basis by fifteen second pauses or relaxation periods. The length of each program in seconds and minutes can also be programmed into the microprocessor 34. Alternating periods of contraction and relaxation, the frequency thereof, and the pressure thereof, can be prescribed by a certified gynecologist.

The microprocessor 34 can also be programmed according to known techniques to record and display the perineal muscle rehabilitation history and progress of the domestic user. This program can be called up by manipulating memory switch 36. Program data, and history data are displayed on digital readout 8. A pressure sensor 38, which can be a conventional pressure transducer, with electronic converter, measures the air pressure in tube connection 40, which is connected to second air tube 16 as shown in FIG. 1. A pressure safety limit can be programmed into the microprocessor 34 or can be built mechanically or electronically into the pressure sensor 38 or related hardware, according to known techniques.

Figure 4:
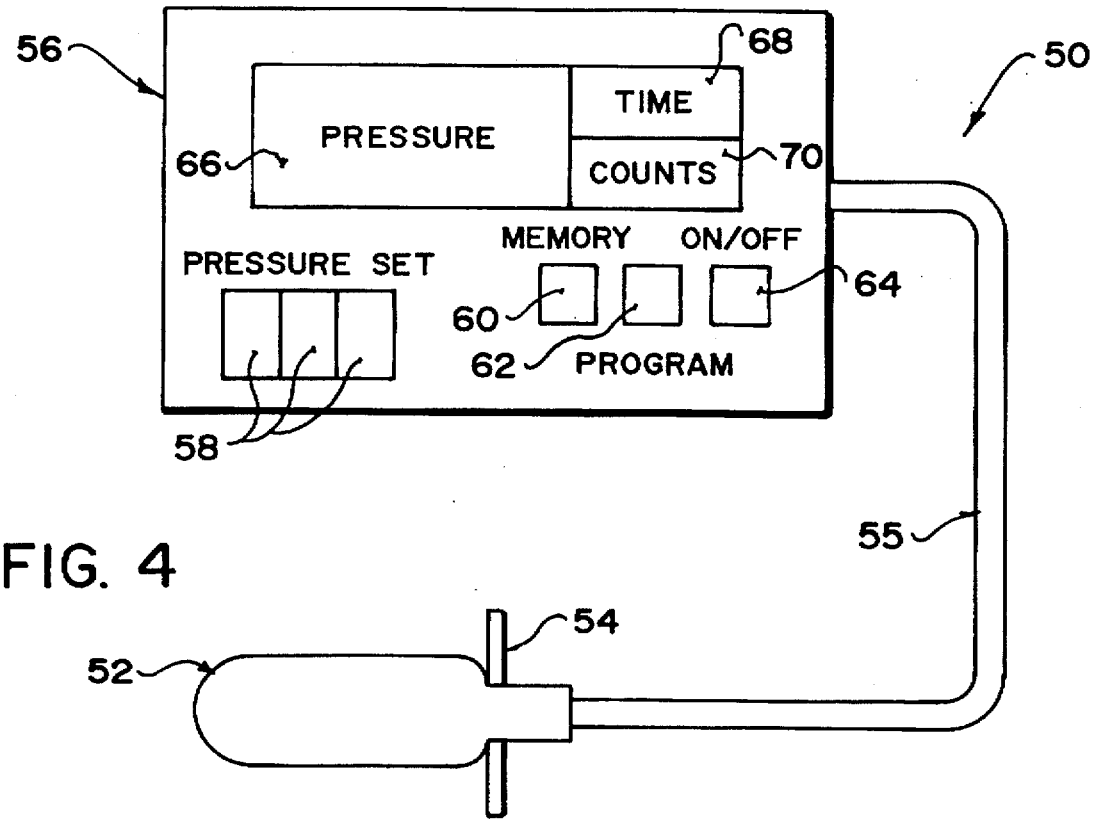
FIG. 4 illustrates a schematic view of an automatic perineometer according to the invention.

FIG. 4 illustrates a schematic view of an automatic perineometer 50 according to the invention. The automatic perineometer 50 as illustrated in FIG. 4 does not require a manually manipulatable valved air bulb 10 (see FIG. 1), and is entirely electronically controlled. A vaginal bulb 52, which is constructed in a manner similar to the bulb 4 that is illustrated and discussed in association with FIG. 2, and a protective flange 54, are connected via air tube 55 to electronic readout board 56. The digital readout board 56 carries a trio of manually manipulatable pressure set buttons 58. These buttons 58 can be used to increase, decrease or maintain specific air pressures according to the needs of the domestic user or as prescribed by a qualified physician. A maximum pressure limit can also be programmed into the microprocessor for the safety of the home user.

The digital display board 56 also carries a manually manipulatable memory button 60, which the domestic user can press to cause the electronic memory of the microprocessor to automatically set air pressure in the perineometer 50 to the same level as used by the domestic user during a previous exercise. A manually operated program button 62 can be used by the domestic user to call up any one of a number of preset programs that can be programmed in the microprocessor. A manually manipulatable on-off switch 64 can be pressed by the user to either turn on or off the perineometer 50. The readout board 56 also carries a digital display panel which displays pneumatic pressure 66, time 68, measured in seconds, and vaginal contraction counts 70. Thus the domestic user can keep track of vaginal muscle contractions and relaxation frequencies and intervals, as well as pressure. The program, pressure, time intervals, and the like can be changed at any time.

Figure 5:
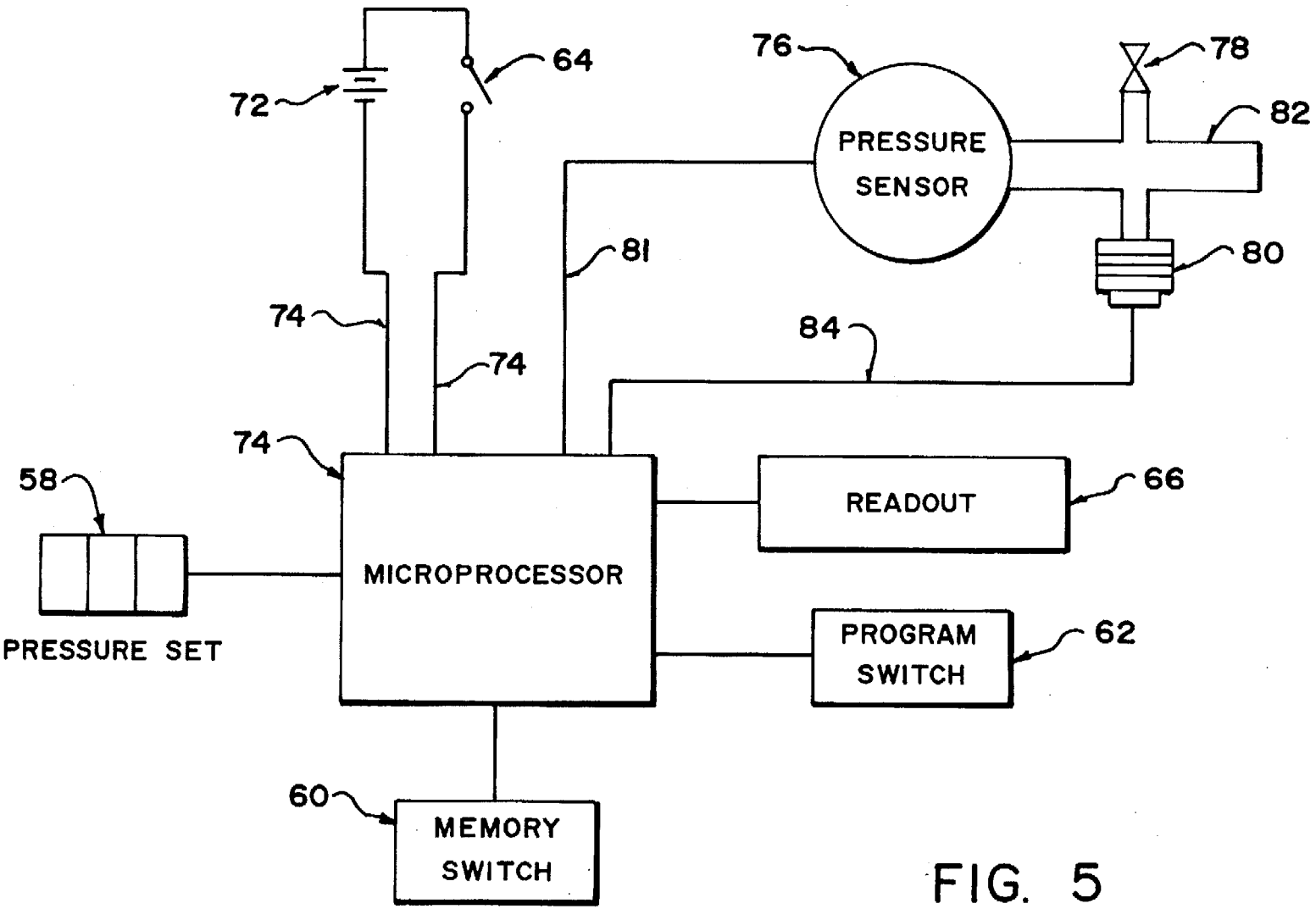
FIG. 5 illustrates a detailed schematic view of the electronics and instrumentation of the automatic perineometer according to the invention.

FIG. 5 illustrates a detailed schematic view of the electronics and instrumentation of the automatic perineometer 50 according to the invention. As can be seen in FIG. 5, the electronics for the automatic perineometer 50 include as a power source an electric battery 72, which can typically be a long life lithium battery or a rechargeable nickel cadmium battery of 2 to 12 volts. Alternatively, the automatic perineometer can be powered from a conventional 110 volt alternating current source, with an adapter and transformer to reduce and alter the electrical current to 6–12 volt direct current. The electrical power supply to the perineometer from battery 72 is controlled via an on-off switch button 64 and flows along wiring 74 to a microprocessor 75. The microprocessor 75 can be programmed using accepted program techniques with a wide variety of selectable exercise and rehabilitation programs according to the needs of the domestic user and as prescribed by a qualified physician. Memory switch button 60, which causes the microprocessor 75 to command that the perineometer return to a previous pneumatic pressure reading or give a previous history, is manually manipulatable by the domestic user.

Program switch button 62 can be used by the domestic user to call up any one of a number of alternative exercise and rehabilitation programs programmed into the microprocessor. These are displayed on readout 66. If the domestic user wants to change the pneumatic pressure, the user can change the pneumatic pressure accordingly by manipulating manual pressure set buttons 58. A pressure sensor 76, is connected to the microprocessor 75 by line 81. By reading electronic information data from the electronic pressure sensor 76, the microprocessor 75 is able to control the pressure in the automatic perineometer to a previous level, maintain the pressure, or decrease or increase the pressure according to commands from the pressure set buttons 58.

A preset safety valve 78, which is positioned between the air pump 80 and the pressure sensor 76, ensures that pneumatic pressures in the automatic perineometer 50 do not exceed predetermined safety levels. An electrically activated bellows type air pump 80 is used to generate pneumatic pressure in the automatic perineometer 50. As seen in FIG. 5, the bellows air pump 80 is controlled via line 84 by microprocessor 75. Tube connection 82 connects the bellows air pump 80, and other components, to air tubing 55, which is illustrated in FIG. 4.

Dougherty et al., in their article entitled "Graded Pelvic Muscle Exercise", the Journal of Reproductive Medicine, 0024-7758/93, utilized a pelvic muscle exercise regimen for determining the effect of such pelvic muscle exercise on stress urinary incontinence in middle-aged and elderly women. The protocol required 16 weeks of exercise, 3 times per week, for a total of 48 sessions. The PME protocol began with sessions requiring 15 repetitions of a 10-second contraction of the pelvic muscles. Ten repetitions were added every four weeks, resulting in 45 repetitions during level 4. An audio cassette tape recording was provided to guide PME sessions.

A similar regimen, as well as other programs, can be programmed into either the microprocessor 34 of the manually inflated perineometer 2 or the microprocessor 75 of the automatic perineometer 50.

G. Elia et al., in an article entitled "Pelvic Muscle Exercises: When Do They Work?", which appeared in the American Journal of Obstetrics and Gynecology, Vol. 81, No. 2, February 1993, reported the results of an evaluation conducted during a 6 month period on 36 women with genuine stress urinary incontinence. Following clinical and urodynamic evaluation, the patients started an active Kegel exercise program. This was conducted by an experienced physiotherapist who enhanced motivation by working on positive clinical feedback and establishing a friendly sympathetic relationship. The subjects were instructed to contract the pelvic muscles for 10 seconds and then relax for 10 seconds. Each cycle of contraction/relaxation was performed in three different positions. The patients first would contract the pelvic muscles standing on their toes, then standing with legs abducted and elbows resting on a chair, and last in the supinedecubitus position with both hands on the abdomen to feel for abdominal muscle contractions. The purpose of the different positions was to avoid Valsalva-type efforts. The adequacy of the contractions was checked on a one-to-one basis by pelvic examination and perineometer; when the patients were considered ready, they started the group sessions. The training program lasted for 3 months and consisted of biweekly group classes for 1.5 hours during the first 6 weeks, and weekly sessions thereafter. The women were asked to perform the exercises at home for 15 minutes four times a day.

Similar programs, as well as other programs, can be programmed into either the microprocessor 34 of the manually inflated perineometer 2 or the microprocessor 75 of the automatic perineometer 50.

L. J. Mcintosh, et al., in an article entitled "Pelvic Floor Rehabilitation in the Treatment of Incontinence", reported in the Journal of Reproductive Medicine, Vol. 38, No. 9, September 1993, reported the results and effectiveness of a pelvic floor rehabilitation program conducted on a sample of 48 women with follow-up interviews from 6 to 3 years. Patients with genuine stress urinary incontinence, unstable bladder and mixed incontinence showed 66%, 33% and 50% respective improvement rate. The strength and duration of pelvic muscle contraction was significantly greater between the first and last visits of all patients, regardless of the subjective improvement. The study concluded that a pelvic floor rehabilitation program was an effective alternative to surgical intervention in reducing the frequency of urinary leakage.

The original perineometer proponent, Arnold H. Kegel, in an article entitled "Early Genital Relaxation, new technic of diagnosis and nonsurgical treatment", which appeared in the November 1956, Vol. 8, No. 5, issue of the American Journal of Obstetrics and Gynecology, recommended the following regimen for using his original design of perineometer. After 5 to 10 correct contractions, the perineometer is inserted, and both physician and patient watch the manometer to note the results of her efforts. The woman may practise exercises with the apparatus in the office for 5 or 10 minutes, during which time the physician has an opportunity to check whether she is contracting according to instructions. The patient is instructed to exercise with the aid of the perineometer for 20 minutes, 2 or 3 times a day. Since frequent repetition is essential for establishing a new reflex pattern, the woman is advised to contract the same muscles without the apparatus 5 to 10 times every half hour, throughout the day, and to interrupt the flow of urine several times whenever she voids. Any of these programs, and others as well, can be programmed into the microprocessor 75 of the automatic perineometer 50 or the microprocessor 34 of the manual perineometer 2.

Some patients using the manual perineometer 2 may find they have some difficulty holding the perineometer 2 in position in the vagina while they are operating the air bulb 10 and doing their exercises. In this case, the patient may wish to use a belt to hold the perineometer in position.

Figures 6, 7:
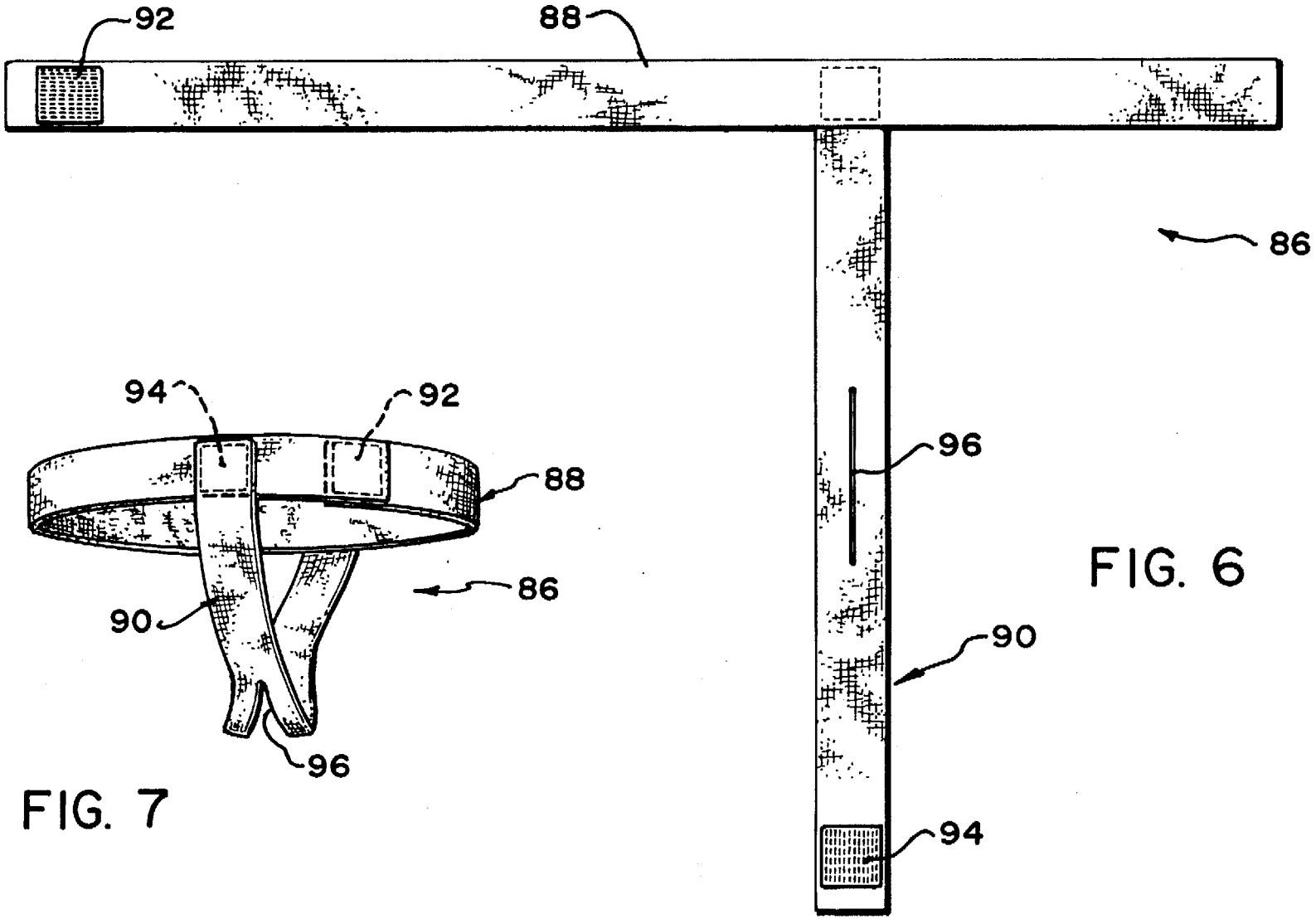
FIG. 6 illustrates a front view of perineometer support belt according to the invention.
FIG. 7 illustrates a perspective view of an assembled perineometer support belt according to the invention.

FIG. 6 illustrates a front view of perineometer support belt according to the invention. FIG. 7 illustrates a perspective view of an assembled perineometer support belt according to the invention. As seen in FIG. 6, the belt 86 is constructed of a flexible waist strap 88 and a right angle crotch strap 90. A conventional hook and pile (Velcro™) fastener 94 is located at the free end of the crotch strap 90 and enables the user to secure the strap 90 snugly about her crotch. A slit 96 is located in the mid-region of the crotch strap 90. This slit 96 fits over the flange 6 of the bulb 4 and holds the flange 6 against the surface area of the vagina and the bulb 4 inside the vagina. The slit 96 also enables the tube 20 of the bulb 4 to protrude through the slit 96 and be connected to the perineometer. The belt 86 can be constructed of any number of flexible materials such as leather, plastic or cloth. Nylon woven belting that does not stretch is especially suitable.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A perineometer for enabling a woman to conduct pelvic muscle strengthening exercises under domestic conditions comprising:

(a) a non-electrically conducting flexible pneumatically inflatable hollow bulb;

(b) a pneumatic pressure generator connected pneumatically to the hollow bulb for generating pneumatic pressure in the hollow bulb;

(c) a perineometer support connected to the hollow bulb (a) or the pneumatic pressure generator or bulb (b), said support comprising (i) a microprocessor, (ii) a source of direct electrical current, (iii) an electronic pneumatic pressure sensor, (iv) a manually manipulatable memory switch electronically connected to the microprocessor, (v) an on-off switch controlling the transmission of electrical current from an electricity storage device to the microprocessor, and (vi) an electronic digital readout display enabling the woman using the perineometer to monitor the effectiveness of the woman's pelvic floor muscle strengthening exercises for reference to the electronic digital readout display.

2. A perineometer as claimed in claim 1 wherein a pressure preset relief valve and a manual air release are connected between the pneumatic pressure generator and the inflatable hollow bulb.

3. A perineometer as claimed in claim 1 including a program in the microprocessor which records past history of pneumatic pressure in the perineometer and enables the microprocessing means to instruct the perineometer to return to the historical pneumatic pressure level.

4. A perineometer as claimed in claim 3 wherein the microprocessor includes programming that enables the woman to monitor the strength, frequency and length of muscle contractions and rest intervals between contractions during pelvic floor muscle strengthening exercises.

5. A perineometer as claimed in claim 1 wherein the hollow bulb includes a non-conducting resilient, hollow inflatable shell, and an internal elongated hollow air tube which enables air to be pumped into or exhausted from the interior of the resilient hollow bulb.

6. A perineometer as claimed in claim 5 wherein the shell of the bulb has a sheath-like construction with a first end and second end, with an opening at the first end, the end of the shell at the second end opposite the opening having in the interior thereof a semi-rigid resilient member for enabling the end of the hollow bulb to retain its shape in inflated or non-inflated condition, and a semi-stiff resilient member at the interior region of the shell at the first end proximate the opening.

7. A perineometer as claimed in claim 6 including a seal for sealing the opening of the hollow bulb to the pneumatic pressure means.

8. A perineometer as claimed in claim 5 including a flange mounted around the periphery of the air tube adjacent the first end of the shell.

9. A perineometer as claimed in claim 1 wherein the support includes manually operated buttons for enabling the woman using the perineometer to set the pneumatic pressure in the bulb when the pressure generator is an electric air pump which is electronically connected to the microprocessor and enables the microprocessor to activate the electric air pump and pressurize the hollow bulb of the perineometer to a pressure programmed into the microprocessor.

10. A perineometer as claimed in claim 9 wherein the perineometer is used by the woman for vaginal muscle rehabilitation and the microprocessor includes a plurality of programmed pressure and relaxation sequences, which are displayed on said electronic display, and enable the woman to follow a program of perineal muscle contractions and rehabilitation exercises.

11. A perineometer as claimed in claim 5 wherein the hollow bulb includes a flexible non-electrically conducting cover which removably fits over the non-conducting shell.

12. A perineometer as claimed in claim 1 including an adjustable belt which can be worn by the woman and holds the hollow bulb in place in the vagina of the woman during pelvic floor strengthening exercises.

13. A perineometer as claimed in claim 12 wherein the belt includes an adjustable length waist strap, an adjustable length crotch strap, and a mechanism in the crotch strap for holding the hollow bulb in place during pelvic floor muscle strengthening exercises.

14. A perineometer as claimed in claim 13 wherein the waist strap and the crotch strap have fasteners thereon which enable an end of the waist strap to be releasably secured to a body portion of the waist strap and an end of the crotch strap to be releasably secured to a body portion of the crotch strap.

15. A method of conducting pelvic floor muscle strengthening exercises by a woman under domestic conditions using a perineometer comprising:

(1) Providing a perineometer including:

(a) a non-electrically conducting flexible pneumatically inflatable hollow bulb;

(b) a pneumatic pressure generator connected pneumatically to the hollow bulb for generating pneumatic pressure in the hollow bulb;

(c) A perineometer support connected to the hollow bulb (a) or the pneumatic pressure generator (b), said support comprising (i) a microprocessor, (ii) a source of direct electrical current, (iii) an electronic pneumatic pressure sensor, (iv) a manually manipulatable memory switch electronically connected to the microprocessor, (v) an on-off switch controlling the transmission of electrical current from an electricity storage device to the microprocessor, and (vi) an electronic digital readout display enabling the woman using the perineometer to monitor the: effectiveness of her perineal muscle strengthening exercises;

(2) inserting the flexible pneumatically inflatable hollow bulb into the vagina of the woman;

(3) generating pneumatic pressure in the hollow bulb;

(4) electronically activating the microprocessor, the electronic pneumatic pressure sensor, the manually manipulatable memory switch electronically connected to the microprocessor, and the electronically digital readout display with a source of direct electrical current, thereby enabling the woman to monitor on the perineometer the performance of her pelvic muscle contractions.

16. A method as claimed in claim 15 including prior to use connecting a high pressure preset relief valve and a manual air release between the pneumatic pressure generator and the inflatable bulb before performing the muscle exercises, to prevent pressure in the hollow bulb exceeding a prescribed level.

17. A method as claimed in claim 15 including prior to use programming the microprocessor with the record of past history of pneumatic pressure in the perineometer, before performing the muscle exercises.

18. A method as claimed in claim 17 including, prior to use, programming the microprocessor with time, pressure fluctuations, and number and frequency parameters to enable the woman to monitor the strength, frequency and length of muscle contractions and rest intervals between contractions during the pelvic floor muscle strengthening exercises.

19. A method as claimed in claim 15 including, prior to use, programming the microprocessor to command the perineometer to return to a historical pneumatic pressure level, and manual button means for enabling the woman to activate an electric air pump which is electrically connected to the microprocessor, the electric air pump pressurizing the perineometer to the pressure programmed into the microprocessor.

20. A method as claimed in claim 15 including prior to use programming a plurality of programmed pressure and relaxation sequences into the microprocessor and displaying the sequences on an electronic display panel which enables the woman to follow a program of perineal muscle contraction and rehabilitation procedures.

* * * * *